US010847854B2

(12) United States Patent
Cao et al.

(10) Patent No.: US 10,847,854 B2
(45) Date of Patent: Nov. 24, 2020

(54) CAVITY RESONATOR DEVICE WITH A COUPLING ELEMENT

(71) Applicant: Alcatel Lucent, Boulogne Billancourt (FR)

(72) Inventors: Yan Cao, Kilsyth (AU); Benedikt Scheid, Kilsyth (AU)

(73) Assignee: Alcatel Lucent, Nozay (FR)

( * ) Notice: Subject to any disclaimer, the term of this patent is extended or adjusted under 35 U.S.C. 154(b) by 0 days.

(21) Appl. No.: 15/738,392

(22) PCT Filed: Jun. 29, 2016

(86) PCT No.: PCT/IB2016/053882
§ 371 (c)(1),
(2) Date: Dec. 20, 2017

(87) PCT Pub. No.: WO2017/002031
PCT Pub. Date: Jan. 5, 2017

(65) Prior Publication Data

US 2018/0175475 A1 Jun. 21, 2018

(30) Foreign Application Priority Data

Jun. 30, 2015 (EP) ..... 15174560

(51) Int. Cl.
*H01P 1/205* (2006.01)
*H01P 7/06* (2006.01)
(Continued)

(52) U.S. Cl.
CPC ..... *H01P 1/2053* (2013.01); *H01P 1/208* (2013.01); *H01P 5/024* (2013.01); *H01P 7/06* (2013.01)

(58) Field of Classification Search
CPC ..... H01P 1/208; H01P 7/06; H01P 1/2053; H01P 5/024
(Continued)

(56) References Cited

U.S. PATENT DOCUMENTS 5,608,363 A 3/1997 Cameron et al.
5,805,033 A 9/1998 Liang et al.
(Continued)

FOREIGN PATENT DOCUMENTS

CN 1745498 A 3/2006
CN 101517823 A 8/2009
(Continued)

OTHER PUBLICATIONS

International Search Report for PCT/IB2016/053882 dated Sep. 27, 2016.

*Primary Examiner* — Rakesh B Patel
(74) *Attorney, Agent, or Firm* — Fay Sharpe LLP

(57) ABSTRACT

The invention relates to a cavity resonator device (1000) comprising at least two adjacent cavity resonators (1010, 1020) for radio frequency, RF, signals, separated by a common side wall (1030) having an opening (1032) wherein said cavity resonator device (1000) comprises at least one coupling element (100) for coupling two adjacent cavity resonators (1010, 1020) of said cavity resonator device (1000) wherein said at least one coupling element (100) comprises a base section (110) and a top section (120), wherein said top section (120) is displaced vertically from said base section (110) by a first distance (d1) along a longitudinal axis (a1) of said coupling element (100), and wherein said coupling element (100) comprises at least a first coupling arm (130) and a second coupling arm (140), each of said coupling arms (130, 140) connecting said base section (110) with said top section (120), wherein said at least one coupling element (100) is arranged rotably around
(Continued)

an axis of rotation with respect to said wall (1030) in said opening (1032), wherein said axis of rotation is said longitudinal axis (a1) of said coupling element (100) or an axis parallel thereto, and wherein said axis of rotation projects through the base section (110) and the top section (120) of the coupling element (100).

15 Claims, 8 Drawing Sheets

(51) Int. Cl.
*H01P 1/208* (2006.01)
*H01P 5/02* (2006.01)

(58) Field of Classification Search
USPC ..... 333/205, 209
See application file for complete search history.

(56) References Cited

U.S. PATENT DOCUMENTS

| | | | | |
|---|---|---|---|---|
| 7,777,593 | B2 | 8/2010 | Weitzenberger | |
| 8,143,973 | B2 * | 3/2012 | Barrois | H01P 1/2053 333/206 |
| 8,217,737 | B2 * | 7/2012 | Reddy | H01P 1/2086 333/202 |
| 9,287,600 | B2 | 3/2016 | Cao et al. | |
| 2006/0103493 | A1 | 5/2006 | Kley et al. | |
| 2008/0068104 | A1 | 3/2008 | Hesselbarth | |
| 2008/0269062 | A1 * | 10/2008 | Ishii | H01P 1/20309 505/210 |

FOREIGN PATENT DOCUMENTS

| | | | |
|---|---|---|---|
| CN | 102025011 | A | 4/2011 |
| CN | 102738542 | A | 10/2012 |
| CN | 203277597 | U | 11/2013 |
| CN | 103441317 | A | 12/2013 |
| CN | 103518287 | A | 1/2014 |
| DE | 33 29 957 | A1 | 2/1985 |
| EP | 2 077 600 | A1 | 7/2009 |
| EP | 2429026 | A1 | 3/2012 |
| EP | 2482377 | B1 | 3/2014 |
| JP | 2008-205692 | A | 9/2008 |
| KR | 2011-0018793 | | 2/2011 |
| WO | WO 2015/144063 | A1 | 10/2015 |

* cited by examiner

CAVITY RESONATOR DEVICE WITH A COUPLING ELEMENT

FIELD OF THE INVENTION

The invention relates to a cavity resonator device comprising a coupling element for coupling two adjacent cavity resonators for radio frequency (RF) signals.

BACKGROUND

Filters for RF signals, e.g. bandpass filters, may be constructed of a plurality of resonators that are coupled (or cross-coupled) by coupling elements. The overall transfer function of the filter is created by the combination of the individual transfer functions of the resonators and the coupling elements. For example, a cavity filter may be implemented as a plurality of interconnected cavity resonators, forming a cavity resonator device. Cavity resonators produce relatively low surface current densities and consequently have relatively high Q-factors. Other resonators such as transverse electromagnetic (TEM) mode (coaxial) resonators can produce relatively large surface current densities, particularly when used to filter RF signals at powers above hundreds of Watts. Cavity resonator filters are therefore often selected for high-power applications such as filtering RF transmissions at powers on the order of tens to hundreds of kilowatts for reasons of transmitter output spectrum control.

SUMMARY

It is an object of the invention to provide an improved coupling element with increased coupling strength as compared to conventional systems. A further object of the invention relates to a cavity resonator device for RF signals comprising such coupling element(s).

According to the embodiments, this object is achieved by a cavity resonator device comprising at least two adjacent cavity resonators for radio frequency, RF, signals, separated by a common side wall having an opening wherein said cavity resonator device comprises at least one coupling element for coupling two adjacent cavity resonators of said cavity resonator device, wherein said at least one coupling element comprises a base section and a top section, wherein said top section is displaced vertically from said base section by a first distance along a longitudinal axis of said coupling element, and wherein said coupling element comprises at least a first coupling arm and a second coupling arm, each of said coupling arms connecting said base section with said top section, wherein said at least one coupling element (100) is arranged rotably around an axis of rotation with respect to said wall in said opening, wherein said axis of rotation is said longitudinal axis of said coupling element or an axis parallel thereto, and wherein said axis of rotation projects through the base section and the top section of the coupling element.

Said coupling element comprises a base section and a top section, wherein said top section is displaced vertically from said base section by a first distance along a longitudinal axis of said coupling element, wherein said coupling element comprises at least a first coupling arm and a second coupling arm, each of said coupling arms connecting said base section with said top section. Particularly, the coupling arms may be distinct from each other, i.e. they do not make electrically conductive contact with each other. Rather, respective end sections of the contact arms make contact with the base section and the top section of the coupling element, respectively.

According to an embodiment, said base section and/or said top section comprises a substantially planar shape. Preferably, said base section and/or said top section substantially comprise a plate shape, i.e. basically a generalized cylindrical shape with a height along a longitudinal axis of the cylindrical shape which is smaller than any dimension of said plate shape in a plane substantially perpendicular to said longitudinal axis.

According to a further embodiment, said first coupling arm comprises a first end section connected to said base section, a second end section connected to said top section, and an intermediate section connecting said first end section with said second end section. Alternatively or in addition thereto, said second coupling arm may comprise a similar or identical shape, i.e., alternatively or in addition to the aforementioned configuration of the first coupling arm, the second coupling arm comprises a first end section connected to said base section, a second end section connected to said top section, and an intermediate section connecting said first end section with said second end section.

According to a further embodiment, at least one of said end sections and/or at least one of said intermediate sections comprises a substantially cylindrical shape. I.e., one or more end section(s) of either the first coupling arm and/or the second coupling arm may comprise a substantially cylindrical shape (wherein "cylindrical" is to be interpreted in the mathematical/geometrical sense of a generalized cylinder, but of course may also comprise e.g. elliptical or circular cylindrical shapes or the like), said substantially cylindrical shape defining a respective longitudinal axis of the respective component. Likewise, the intermediate section(s) of either the first coupling arm and/or the second coupling arm may comprise a substantially cylindrical shape (wherein "cylindrical" again is to be interpreted in the mathematical sense of a generalized cylinder, but of course may also comprise e.g. elliptical or circular cylindrical shapes or the like), said substantially cylindrical shape defining a respective longitudinal axis of the respective intermediate section.

According to a further embodiment, a longitudinal axis of at least one of said end sections (of either the first or second coupling arm or of both coupling arms) is substantially parallel to said longitudinal axis of said coupling element. In this respect, "substantially parallel" means that an angle between the respective longitudinal axes ranges from about −10 degrees to about +10 degrees.

According to a further embodiment, a first angle between said first end section and said intermediate section of said first coupling arm and/or a second angle between said second end section and said intermediate section of said first coupling arm and/or a third angle between said first end section and said intermediate section of said second coupling arm and/or a fourth angle between said second end section and said intermediate section of said second coupling arm ranges between about 50 degrees and about 130 degrees, preferably between about 80 degrees and about 120 degrees, more preferably between about 90 degrees and about 110 degrees. According to this embodiment, two or more of the first to fourth angles may be identical or basically identical (relative difference between the angles smaller than 10 percent) to each other. According to further variants of this embodiment, two or more of the first to fourth angles may also comprise different values within the abovementioned ranges each.

According to a further embodiment, at least one of said coupling arms is arranged in a respective virtual plane, wherein an angle between said respective virtual plane and said longitudinal axis of said coupling element ranges between about −20 degrees and about 20 degrees, preferably between about −5 degrees and about 5 degrees. In other words, at least one coupling arm comprises a basically planar configuration along a respective virtual plane. I.e., the end sections and the intermediate section of said at least one coupling arm—or their longitudinal axes, respectively—basically lie within said respective virtual plane.

According to a further embodiment, if both coupling arms are basically planar and thus lying in a respective virtual plane, a distance between said virtual planes (or a respective surface of the two coupling arms) may range between about 2 millimeter (mm) and about 100 mm, preferably between about 10 mm and about 50 mm.

According to a further embodiment, the first end sections of the first and second coupling arms are arranged in opposing axial end sections of said base section. Alternatively or in addition, the second end sections of the first and second coupling arms are arranged in opposing axial end sections of said top section.

According to a further embodiment, a surface of at least one of said coupling arms is curved and comprises a minimum curve radius of about 1 millimeter, preferably of about 5 mm.

According to a further embodiment, at least one component of said coupling element is made of electrically conductive material and/or comprises an electrically conductive surface, wherein preferably at least one component is made of metal (e.g., copper) and/or comprises a metallic or metallized surface (e.g., made of copper or silver or the like). The aforementioned variants may also be combined with each other. E.g., according to a further embodiment, the base and top sections may e.g. comprise a basically electrically non-conductive main body, said main bodies being coated with one or more electrically conductive layers, while said coupling arms may comprise electrically conductive material such as copper wire or hollow metallic tubes or the like, said coupling arms being electrically conductively coupled to said base and top sections with their respective end sections.

According to a further embodiment, at least one of said coupling arms at least partially comprises an elliptically cylindrical section. Preferably, according to a further embodiment, the coupling arms basically comprise a circular cylindrical shape, either with constant radius of said circular cylindrical shape along a length coordinate of said coupling arm (which length coordinate may also be curved depending on the angular orientation of the end sections with respect to the intermediate section of the coupling arm), or with a radius of said circular cylindrical shape varying along said length coordinate of said coupling arm.

According to a further embodiment, at least one further (i.e., third) coupling arm is provided which connects said base section with said top section in a fashion similar or identical to the first and second coupling arms explained above. Also, according to further embodiments, the third or any further coupling arm may also comprise configurations regarding end sections and/or intermediate sections, angular ranges therebetween and between further coupling arms as explained in detail above for the first and second coupling arms.

The cavity resonator device may e.g. represent or form part of a filter for RF signals.

Advantageous embodiments are the following:

wall sections adjacent to said opening comprise a slanted front section;

a tuning mechanism is provided which is coupled with said coupling element for driving movement, preferably rotatable movement, of said coupling element with respect to said wall;

said coupling element is arranged in said opening such that a first portion of its first coupling arm is positioned within a first one of said adjacent cavity resonators, and that a second portion of its first coupling arm is positioned within a second one of said adjacent cavity resonators, and wherein preferably said coupling element is arranged in said opening such that a first portion of its second coupling arm is positioned within said second one of said adjacent cavity resonators, and that a second portion of its second coupling arm is positioned within said first one of said adjacent cavity resonators.

Further advantageous features of the invention are defined and are described in the following detailed description of the invention.

BRIEF DESCRIPTION OF THE FIGURES

The embodiments of the invention will become apparent in the following detailed description and will be illustrated by accompanying figures given by way of non-limiting illustrations, wherein.

DESCRIPTION OF THE EMBODIMENTS

Figure 1:
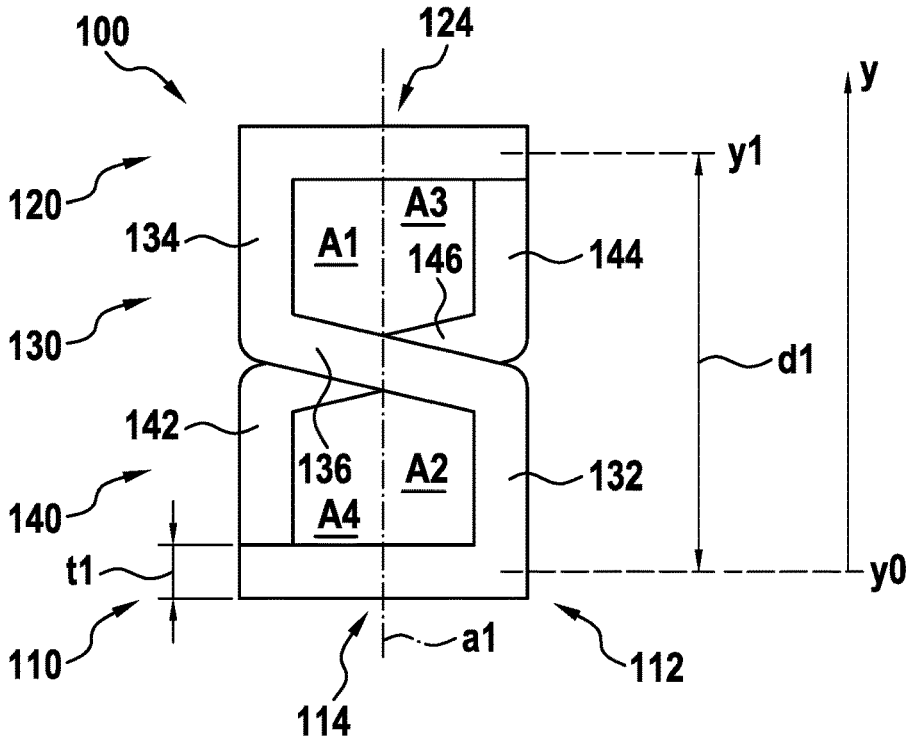
FIG. 1 schematically depicts a front view of a coupling element according to an embodiment, FIG. 2 schematically depicts a first coupling arm of the coupling element according to FIG. 1, FIG. 3 schematically depicts a second coupling arm of the coupling element according to FIG. 1, FIG. 4 schematically depicts a perspective view of a coupling element according to an embodiment, FIG. 5 schematically depicts a side view of a coupling element according to an embodiment, FIG. 6 schematically depicts a front view of a coupling element according to a further embodiment, FIG. 7 schematically depicts a top view of a coupling element according to a further embodiment, FIG. 8 schematically depicts a top view of a cavity resonator device according to an embodiment, FIG. 9 schematically depicts a front view of a cavity resonator device according to an embodiment, FIG. 10 schematically depicts a top view of a cavity resonator device according to a further embodiment, FIG. 11 schematically depicts a top view of a cross-section of a filter according to an embodiment, and FIG. 12 schematically depicts an electrical equivalent circuit according to an embodiment.

FIG. 1 schematically depicts a front view of a coupling element 100 according to a first embodiment. The coupling element 100 may e.g. be used within a cavity resonator device 1000 for RF signals, cf. the top view of FIG. 8, such as a bandpass filter.

The cavity resonator device 1000 may e.g. comprise at least two adjacent cavity resonators 1010, 1020 separated by a common side wall 1030. The side wall 1030 may have an opening 1032 as depicted by FIG. 8, and in said opening 1032, the coupling element 100 according to the embodiments may be arranged to enable a per se known coupling between the adjacent cavity resonators 1010, 1020.

According to a preferred embodiment, said coupling element 100 is arranged movably with respect to said wall 1030 in said opening 1032, said movement e.g. comprising translation and/or rotation.

Figure 8:
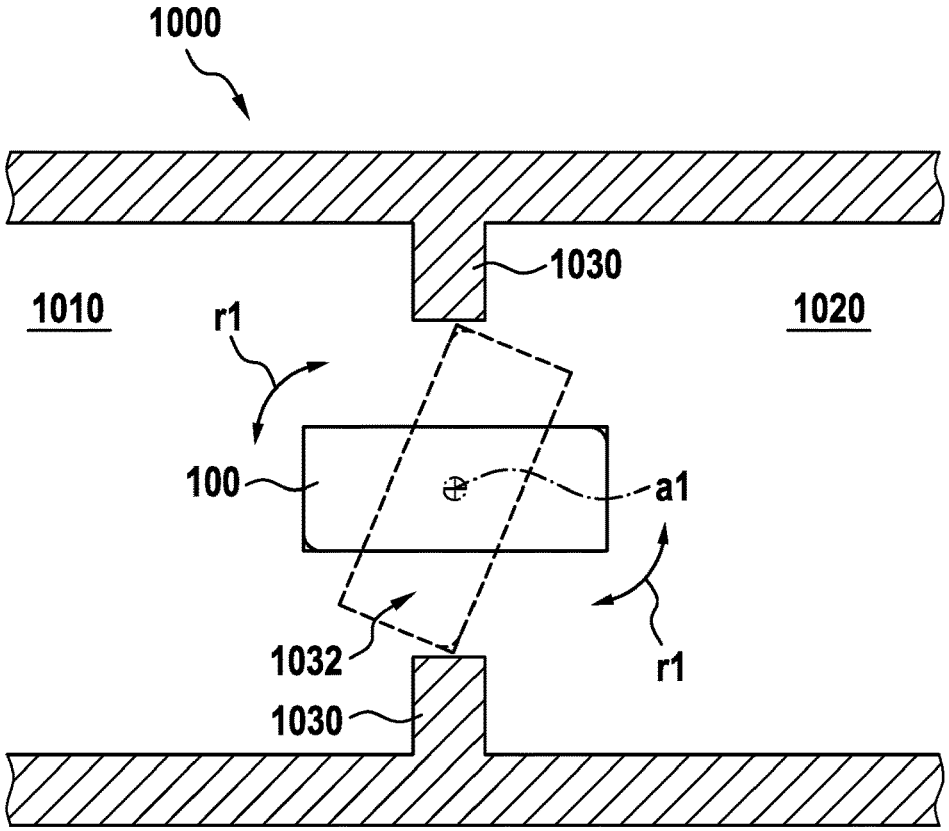

According to a particularly preferred embodiment, which is depicted by FIG. 8, said coupling element 100 is arranged rotatably with respect to said wall 1030 in said opening 1032, wherein presently the coupling element 100 is arranged rotatably around its longitudinal axis a1 that extends basically perpendicular to the drawing plane of FIG. 8. The rotatable movement is also indicated by the double arrows r1 in FIG. 8 and the dotted rectangular shape indicating the coupling element in a different rotational position. By performing such rotation r1 within the opening 1032, the coupling element 100 influences the coupling strength between said cavity resonators 1010, 1020 thus enabling to tune a frequency characteristic of the cavity resonator device 1000.

Alternatively to the configuration depicted by FIG. 8, a rotational movement around an axis (not shown) substantially parallel (but not identical to) the longitudinal axis a1 is also possible according to a further embodiment.

According to a further embodiment, the rotational movement r1 of the coupling element 100 may either be unlimited or limited to a predetermined range of about e.g. 360 degrees, or 180 degrees or less.

Returning to FIG. 1, the coupling element 100 comprises a base section 110 and a top section 120, wherein said top section 120 is displaced vertically from said base section 110 by a first distance d1 along said longitudinal axis a1 of said coupling element 100. The coupling element 100 comprises at least a first coupling arm 130 and a second coupling arm 140, wherein said first coupling arm 130 connects said base section 110 with said top section 120, and wherein said second coupling arm 140 also connects said base section 110 with said top section 120.

According to an embodiment, the coupling arms 130, 140 may be distinct from each other, i.e. they do not make electrically conductive contact with each other. Rather, respective end sections 132, 142, 134, 144 of the contact arms 130, 140 make contact with the base section 110 and the top section 120 of the coupling element 100, respectively.

According to an embodiment, said base section 110 and/or said top section 120 comprises a substantially planar shape. Preferably, said base section 110 and/or said top section 120 substantially comprise a plate shape, i.e. basically a generalized cylindrical shape with a height t1 along a longitudinal axis a1 of the cylindrical shape (or along the vertical coordinate y in FIG. 1) which is smaller than any dimension of said plate shape in a plane substantially perpendicular to said longitudinal axis a1.

According to a further embodiment, said first coupling arm 130 comprises a first end section 132 connected to said base section 110, a second end section 134 connected to said top section 120, and an intermediate section 136 connecting said first end section 132 with said second end section 134. Alternatively or in addition thereto, said second coupling arm 140 may comprise a similar or identical shape, i.e., alternatively or in addition to the aforementioned configuration of the first coupling arm 130, the second coupling arm 140 comprises a first end section 142 connected to said base section 110, a second end section 144 connected to said top section 120, and an intermediate section 146 connecting said first end section 142 with said second end section 144.

Generally, the expression "connecting" in the context of the aforementioned structure of the coupling arms 130, 140 and their connections to the base and top sections 110, 120 shall denote an electrically conductive (i.e., galvanic) connection of the respective components with each other, at least as far as a surface of the respective components is concerned (and a penetration depth of electric currents as required by an operational frequency range of the coupling element 100 or the cavity resonator device 1000, e.g. the Skin depth or a multiple thereof). In other words, according to some embodiments, said electrically conductive connection may be established by an electrically conductive coating of or layer on of the respective components 110, 120, 130, 140 which comprises a thickness of about a Skin depth or a multiple thereof, e.g. about 3 micrometers (μm) or more for signals frequencies of about 500 MHz (Megahertz). Of course, alternatively or in addition, some or all components 110, 120, 130, 140 may also comprise solid metallic bodies or hollow metallic bodies (with corresponding wall thickness, cf. the observations with respect to the Skin depth above).

According to a further embodiment, at least one of said end sections 132, 142, 134, 144 and/or at least one of said intermediate sections 136, 146 comprises a substantially cylindrical shape. I.e., one or more end section(s) of either the first coupling arm 130 and/or the second coupling arm 140 may comprise a substantially cylindrical shape (wherein "cylindrical" is to be interpreted in the mathematical sense of a generalized cylinder, but of course may also comprise e.g. elliptical or circular cylindrical shapes or the like), said substantially cylindrical shape defining a respective longitudinal axis of the respective component. Likewise, the intermediate section(s) 136, 146 of either the first coupling arm 130 and/or the second coupling arm 140 may comprise a substantially cylindrical shape (wherein "cylindrical" again is to be interpreted in the mathematical sense of a generalized cylinder, but of course may also comprise e.g. elliptical or circular cylindrical shapes or the like), said substantially cylindrical shape defining a respective longitudinal axis of the respective intermediate section 136.

Figure 2:
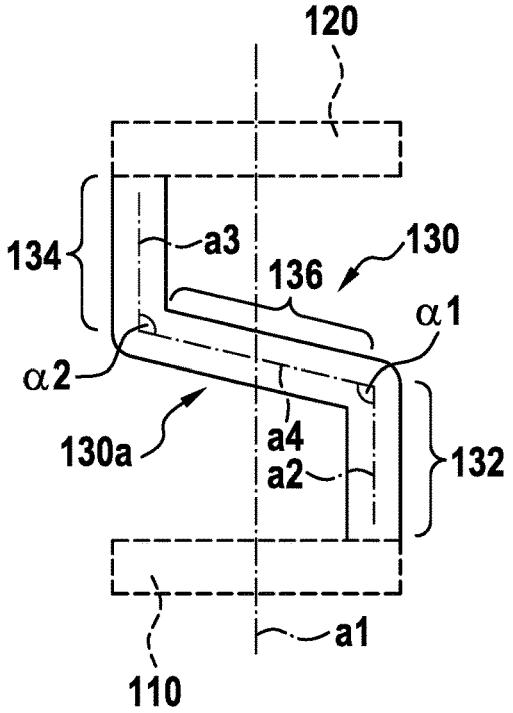

FIG. 2 schematically depicts the first coupling arm 130 of the coupling element 100 according to FIG. 1 in a front view comparable to that of FIG. 1. The base and top sections 110, 120 are illustrated by dotted lines only for the sake of clarity. The first end section 132 of the first coupling arm 130 comprises a longitudinal axis a2, which is presently arranged substantially parallel to the longitudinal axis a1 of the coupling element 100 (FIG. 1). The second end section 134 of the first coupling arm 130 comprises a longitudinal axis a3, which is presently also arranged substantially parallel to the longitudinal axis a1 of the coupling element 100 (FIG. 1). The intermediate section 136 connecting said end sections 132, 134 with each other comprises a longitudinal axis a4.

According to a further embodiment, the longitudinal axis a2, a3 of at least one of said end sections 132, 134 is substantially parallel to said longitudinal axis a1 of said coupling element 100. In this respect, "substantially parallel" means that an angle between the respective longitudinal axes a2, a3 and a1 ranges from about −10 degrees to about +10 degrees.

According to a further embodiment, a first angle $\alpha 1$ between said first end section 132 and said intermediate section 136 of said first coupling arm 130 and/or a second angle $\alpha 2$ between said second end section 134 and said intermediate section 136 of said first coupling arm 130 ranges between about 50 degrees and about 130 degrees, preferably between about 80 degrees and about 120 degrees, more preferably between about 90 degrees and about 110 degrees. Presently, as depicted in FIG. 2, the first and second angles α1, α2 are chosen to be about 120 degrees. However, according to further embodiments, the first and second angles α1, α2 may also be different from each other.

Figure 3:
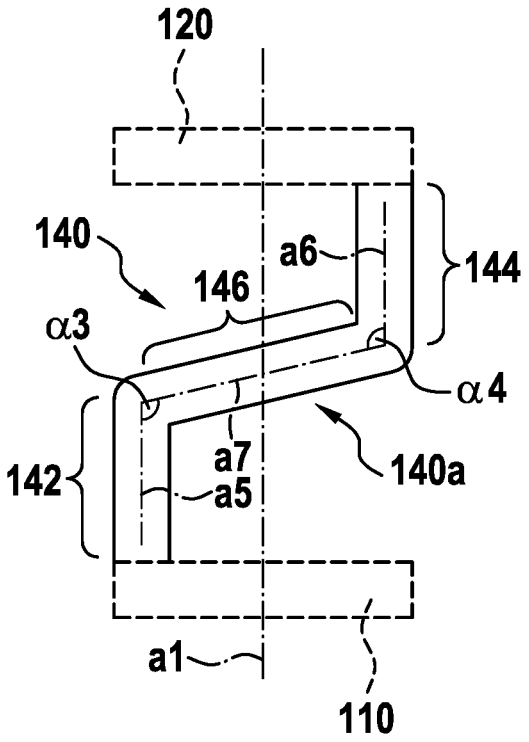

FIG. 3 schematically depicts the second coupling arm 140 of the coupling element 100 according to FIG. 1 in a front view comparable to that of FIG. 1. Presently, the second coupling arm 140 comprises a geometry basically similar or identical to the one of the first coupling arm 130 as depicted by FIG. 2. The base and top sections 110, 120 are illustrated in FIG. 3 by dotted lines only, and the first coupling arm 130 is omitted in FIG. 3, for the sake of clarity. The first end section 142 of the second coupling arm 140 comprises a longitudinal axis a5, which is presently arranged substantially parallel to the longitudinal axis a1 of the coupling element 100 (FIG. 1). The second end section 144 of the second coupling arm 140 comprises a longitudinal axis a6, which is presently also arranged substantially parallel to the longitudinal axis a1 of the coupling element 100 (FIG. 1). The intermediate section 146 connecting said end sections 142, 144 with each other comprises a longitudinal axis a7.

According to an embodiment, the intermediate sections 136, 146 (FIG. 1) of the two coupling arms 130, 140 are not parallel to each other, but rather include an angle (not shown) of about 10 degrees or more, preferably about 20 degrees or more, which reduces an undesired magnetic coupling between said intermediate sections 136, 146.

According to a further embodiment, the longitudinal axis a5, a6 of at least one of said end sections 142, 144 is substantially parallel to said longitudinal axis a1 of said coupling element 100. In this respect, "substantially parallel" means that an angle between the respective longitudinal axes a5, a6 and a1 ranges from about −10 degrees to about +10 degrees.

According to a further embodiment, a third angle α3 between said first end section 142 and said intermediate section 146 of said second coupling arm 140 and/or a fourth angle α4 between said second end section 144 and said intermediate section 146 of said second coupling arm 140 ranges between about 50 degrees and about 130 degrees, preferably between about 80 degrees and about 120 degrees, more preferably between about 90 degrees and about 110 degrees. Presently, as depicted in FIG. 3, the third and fourth angles α3, α4 are chosen to be about 120 degrees. However, according to further embodiments, the third and fourth angles α3, α4 may also be different from each other (and also similar to or different from the first and second angles α1, α2 of the first coupling arm 130, cf. FIG. 2).

Figure 4:
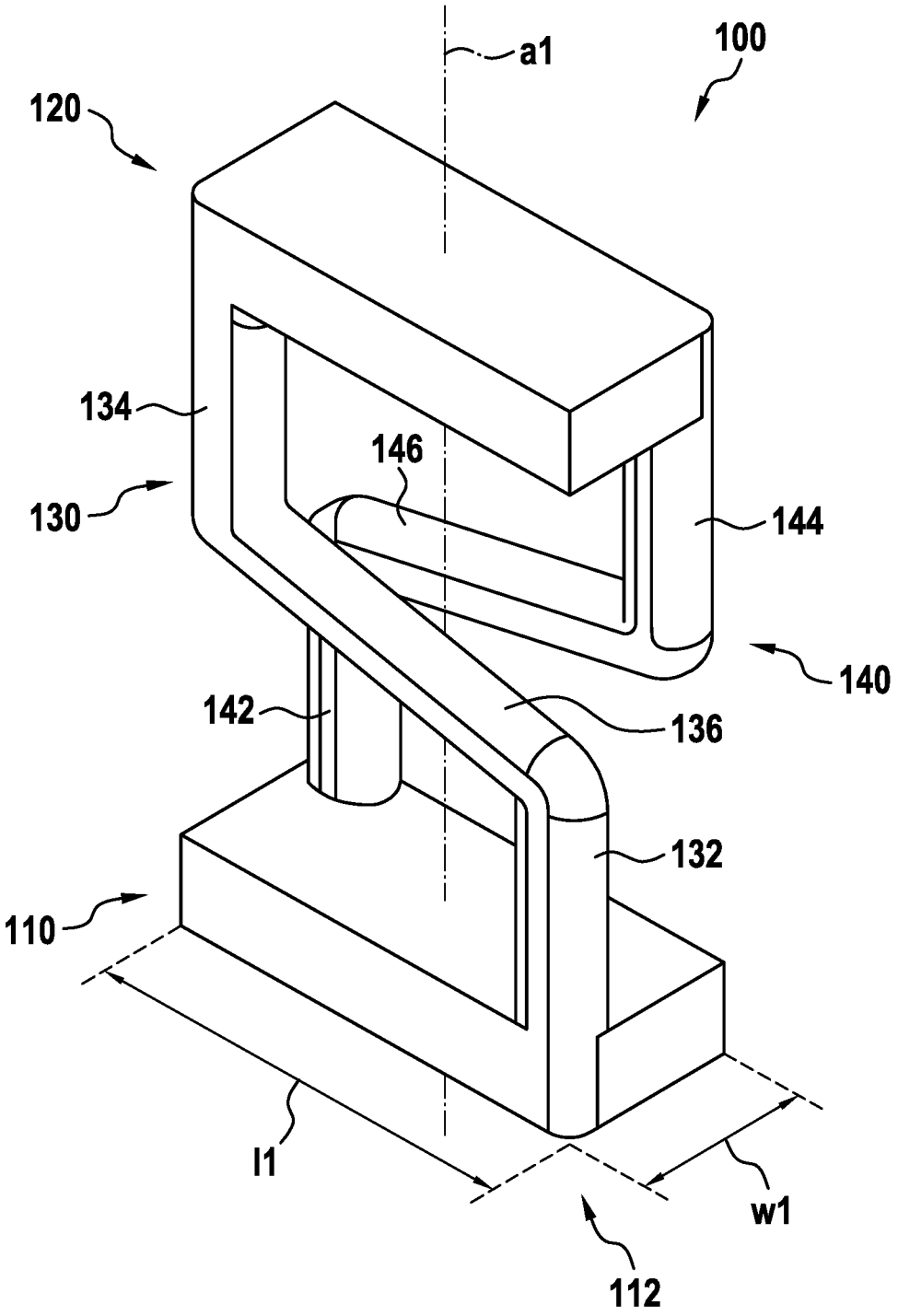

FIG. 4 schematically depicts a perspective view of a coupling element 100 according to an embodiment. It can be seen that presently the base and top sections 110, 120 comprise basically rectangular cylindrical shape with a width w1 and a length 11. Presently, the height t1 (cf. FIG. 1) is smaller than said width w1 and said length 11, whereby a "plate shape" is attained for the base and top sections 110, 120. However, according to other embodiments, different shapes a possible for said base and top sections 110, 120, wherein said base section 110 may also comprise a different shape than said top section 120.

According to a further embodiment, one or more of said components 110, 120, 130, 140 of the coupling element 100—or a respective surface thereof (also cf. the surface 130*a* of the first coupling arm 130 of FIG. 2)—may be curved and may comprise a minimum curve radius of about 1 millimetres, preferably of about 5 mm. Curved edges of e.g. the base and/or top section(s) 110, 120 are also possible, cf. reference sign 112.

According to a further embodiment, at least one of said coupling arms 130, 140 (FIG. 4) at least partially comprises an elliptically cylindrical section. Preferably, according to a further embodiment, the coupling arms basically comprise a circular cylindrical shape, as schematically depicted by FIG. 4. Presently said circular cylindrical shape comprises a substantially constant radius along a length coordinate of said coupling arm (which length coordinate may also be curved depending on the angular orientation of the end sections with respect to the intermediate section of the coupling arm). Alternatively or in addition, a radius of said circular cylindrical shape may also vary (not shown) along said length coordinate of said coupling arm, at least for one or more sections 132, 134, 136, 142, 144, 146 thereof.

According to a further embodiment, at least one component 110, 120, 130, 140 of said coupling element 100 is made of electrically conductive material and/or comprises an electrically conductive surface, wherein preferably at least one component is made of metal (e.g., copper) and/or comprises a metallic or metallized surface 124, 114, cf. FIG. 1, (e.g., made of copper or silver or the like). The aforementioned variants may also be combined with each other. E.g., according to a further embodiment, the base and top sections may e.g. comprise a basically electrically non-conductive main body, said main bodies being coated with one or more electrically conductive layers, while said coupling arms may comprise electrically conductive material such as copper wire or hollow metallic tubes or the like, said coupling arms being electrically conductively coupled to said base and top sections with their respective end sections.

According to a further embodiment, at least one further (i.e., third) coupling arm (not shown) is provided which connects said base section 110 with said top section 120 in a fashion similar or identical to the first and second coupling arms 130, 140 explained above. Also, according to further embodiments, the third or any further coupling arm may also comprise configurations regarding end sections 132, 134 and/or intermediate sections 136, angular ranges therebetween and between further coupling arms as explained in detail above for the first and second coupling arms 130, 140.

Figure 5:
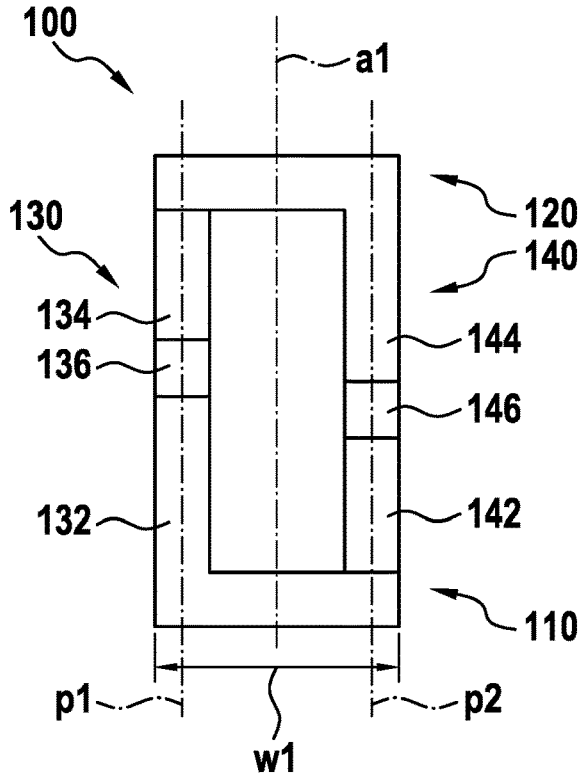

FIG. 5 schematically depicts a side view of a coupling element 100 according to an embodiment. As can be seen from FIG. 5, both coupling arms 130, 140 comprise a basically planar configuration in that the first and second end sections 132, 134 and the intermediate section 136 of the first coupling arm 130 lies in a virtual plane p1, which is presently substantially parallel to the longitudinal axis a1. Also, the first and second end sections 142, 144 and the intermediate section 146 of the second coupling arm 140 lies in a virtual plane p2, which is presently substantially parallel to the longitudinal axis a1. In other words, the virtual planes p1, p2 each comprising one coupling arm 130, 140 are substantially parallel to each other. Preferably, according to a further embodiment, the virtual planes p1, p2 are each arranged with a non-vanishing distance to said longitudinal axis a1 (i.e., the plane(s) p1, p2 not comprising said longitudinal axis a1), said longitudinal axis a1 preferably being arranged between said virtual planes p1, p2.

According to a further embodiment, at least one of said coupling arms 130, 140 is arranged in a respective virtual plane p1, p2, wherein an angle between said respective virtual plane p1, p2 and said longitudinal axis a1 of said coupling element 100 ranges between about −20 degrees and about 20 degrees, preferably between about −5 degrees and about 5 degrees. In other words, at least one coupling arm 130, 140 comprises a basically planar configuration along a respective virtual plane p1, p2, as stated above. I.e., the end sections and the intermediate section of said at least one coupling arm—or their longitudinal axes, respectively—basically lie within said respective virtual plane.

According to a further embodiment, if both coupling arms are basically planar and thus lying in a respective virtual plane, a distance between said virtual planes (or a respective surface of the two coupling arms) may range between about 2 millimetres (mm) and about 100 mm, preferably between about 10 mm and about 50 mm.

However, according to further embodiments, at least one coupling arm 130, 140, . . . may comprise a non-planar configuration (not shown), i.e. at least one section 132, 134, 136 of a specific coupling arm 130 lies outside a first virtual plane p1 comprising one or more other sections of said specific coupling arm 130.

Figure 6:
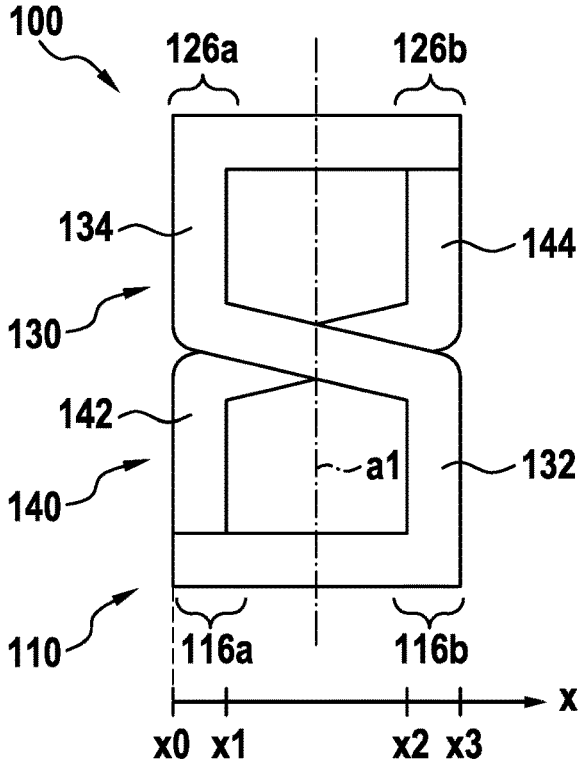

FIG. 6 schematically depicts a front view of a coupling element 100 according to a further embodiment, wherein the first end sections 132, 142 of the first and second coupling arms 130, 140 are arranged in opposing axial end sections of said base section 110. An longitudinal axis of said base section 110 is parallel to the depicted coordinate axis x, wherein the first end section 142 of the second coupling arm 140 is arranged within an interval (x0, x1), wherein x1>x0, and wherein x0, x1 denote coordinates along said coordinate axis x, said interval (x0, x1) representing a first axial end section 116*a* of the base section 110. The first end section 132 of the first coupling arm 130 is arranged within an interval (x2, x3), wherein x3>x2>x1, and wherein x3, x2 denote further coordinates along said coordinate axis x, said interval (x2, x3) representing a second axial end section 116*b* of the base section 110, which is arranged opposite to said first axial end section 116*a* of the base section 110 along the axis x. Alternatively or in addition, the second end sections 134, 144 of the first and second coupling arms 130, 140 may be arranged in opposing axial end sections 126*a*, 126*b* of said top section.

Figure 7:
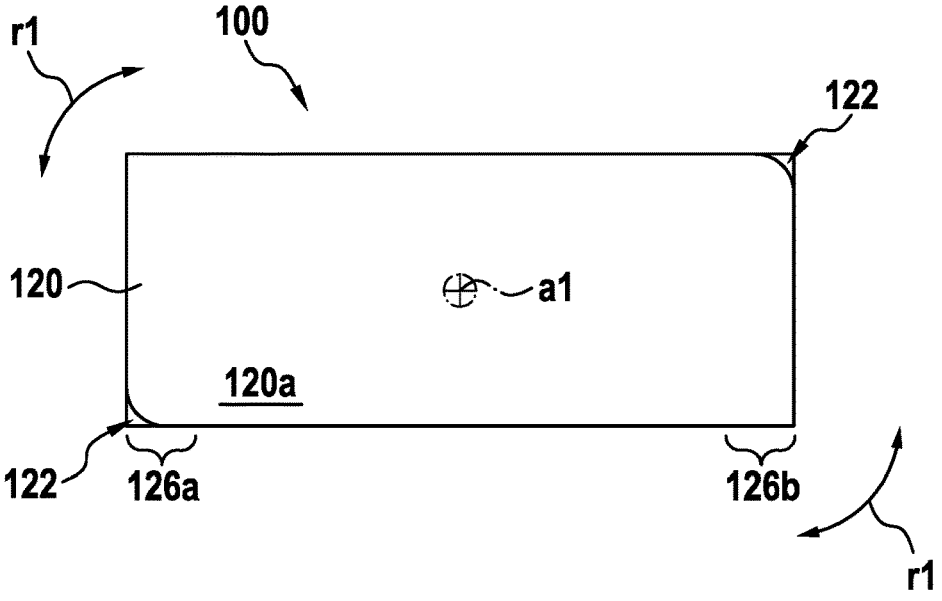

FIG. 7 schematically depicts a top view of a coupling element 100 according to a further embodiment. A top surface 122 of the top section 120 may have one or more rounded or curved edges 122. According to a particularly preferred embodiment, said coupling element 100 is arranged rotatably in a target system, such as the cavity resonator device 1000 already explained above with reference to FIG. 8, with respect to a component of said target system. E.g., the coupling element 100 may be arranged rotatably around its longitudinal axis a1, cf. FIG. 7, that extends basically perpendicular to the drawing plane of FIG. 7, whereby the rotational degree of freedom is indicated in FIG. 7 by means of the double arrows r1.

As explained above, FIG. 8 schematically depicts a top view of the cavity resonator device 1000 with the coupling element 100 arranged rotatably around its longitudinal axis a1 in an opening 1032 of a side wall 1030 of said cavity resonator device 1000. According to an embodiment, the opening can be partial, meaning that the depth or length of the opening is not necessarily equal to the cavity height.

Figure 9:
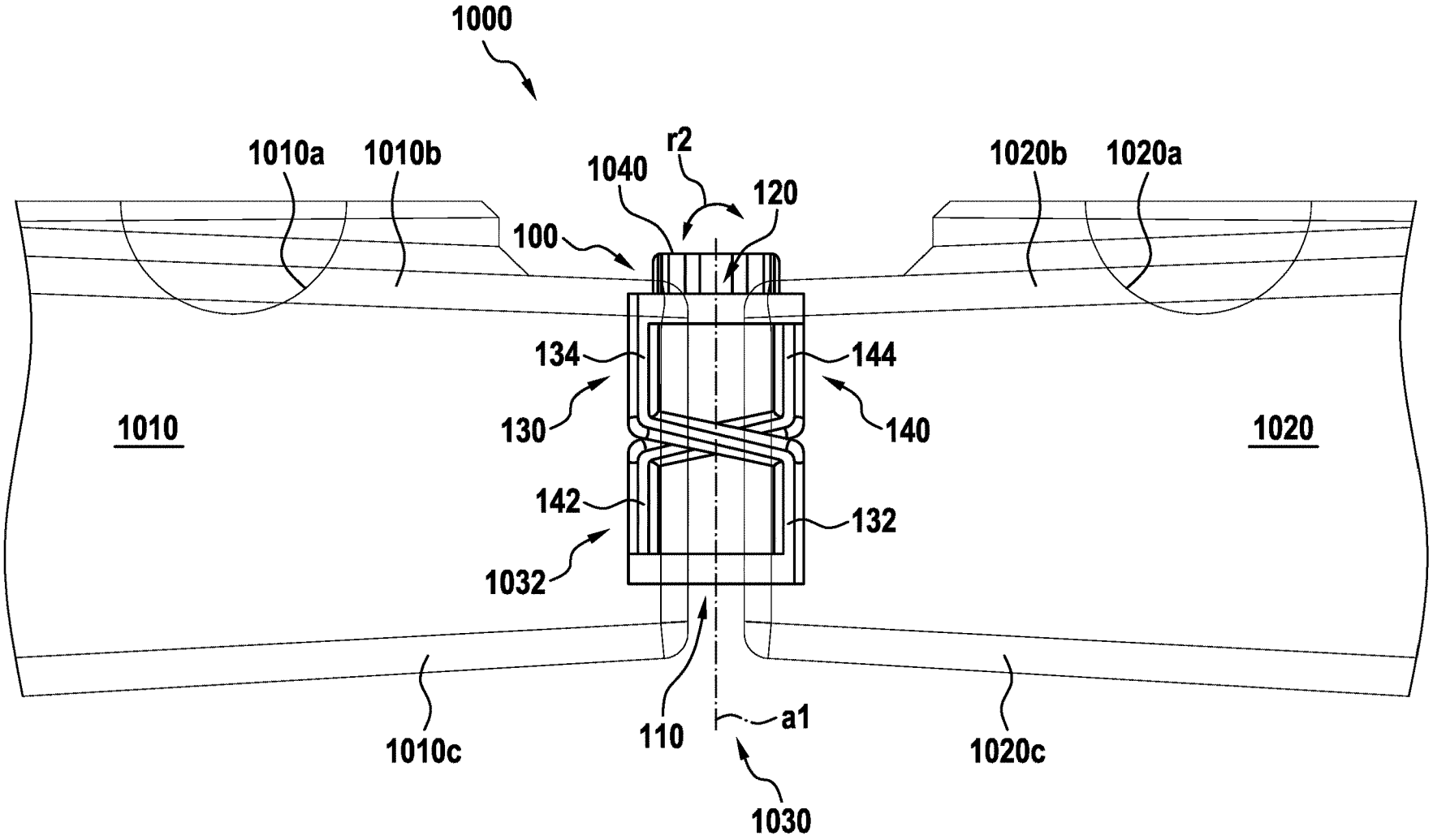

FIG. 9 schematically depicts a front view of the cavity resonator device 1000 of FIG. 8, and it can be seen that the coupling element 100 extends partially into both adjacent cavity resonators 1010, 1020 of the cavity resonator device 1000.

More specifically, according to an embodiment, said coupling element 100 is arranged in said opening 1032 (FIG. 8) such that a first portion of its first coupling arm 130 (FIG. 9) is positioned within a first one of said adjacent cavity resonators and that a second portion of its first coupling arm is positioned within a second one of said adjacent cavity resonators, wherein preferably said coupling element 100 is further arranged in said opening such that a first portion of its second coupling arm 140 is positioned within a said second one of said adjacent cavity resonators and that a second portion of its second coupling arm 140 is positioned within said first one 1010 of said adjacent cavity resonators. Presently, as depicted by FIG. 9, the first end section 132 of the first coupling arm 130 is positioned within the cavity resonator 1020 and the second end section 134 of the first coupling arm 130 is positioned within the adjacent cavity resonator 1010, and the first end section 142 of the second coupling arm 140 is positioned within said cavity resonator 1010, and the second end section 144 of the second coupling arm 140 is positioned within said cavity resonator 1020.

According to a further embodiment, a tuning mechanism 1040, e.g. comprising a tuning knob, is provided which is coupled with said coupling element 100 for driving movement, preferably rotatable movement, of said coupling element 100 with respect to said wall 1030 (FIG. 8). Thus, the degree of coupling between the cavity resonators 1010, 1020 defined by the coupling element 100 and its rotational position within the opening 1032 in the wall 1030 may be altered by actuating the tuning knob 1040 external to the resonator cavities, which is also possible during operation of said cavity resonator device.

According to a further embodiment, per se known loading elements 1010*a*, 1020*a* may be provided within said cavity resonators 1010, 1020. The loading elements 1110, 1120 may also be adjustable according to some embodiments.

Figure 10:
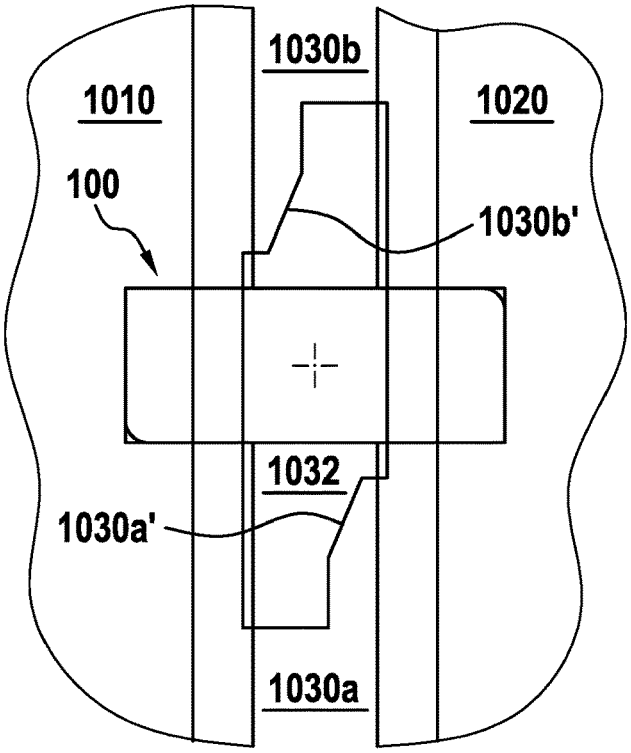

According to a further embodiment, cf. FIG. 10, wall sections 1030*a*, 1030*b* adjacent to said opening 1032 comprise a slanted front section 1030*a*', 1030*b*', which enables to extend a rotational movement range of the coupling element 100 within said opening 1032.

Advantageously, the coupling element 100 according to the embodiments enables an adjustable phase-reversing coupling between cavity resonators 1010, 1020 with an increased coupling strength as compared to conventional systems.

Using the coupling element 100 according to the embodiments, cavity resonator devices 1000 such as high-power bandpass filters for RF signals may be provided, which may e.g. operate in frequency ranges of about 50 MHz up to about some GHz and in power ranges of about some Watts (W) up to 100 kW (kilowatt) or even more.

Figure 11:
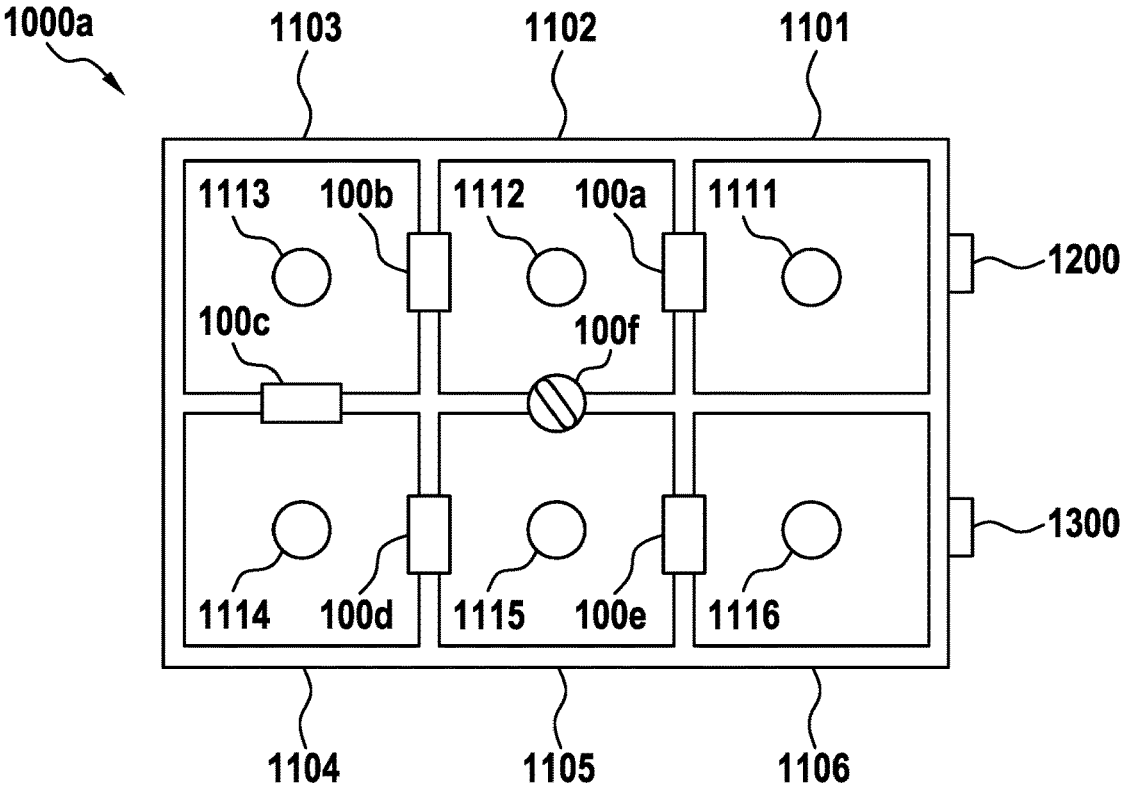

FIG. 11 is a top view of a cross-section of a cavity resonator device 1000*a* configured as a filter for RF signals according to some embodiments. The cross-sectional view is perpendicular to a base plate (not shown in FIG. 11) of the filter 1000*a* and a cover plate (not shown in FIG. 11) of the filter 1000*a* and the cross-section is located within the filter 1000*a* between the base plate and the cover plate. Some embodiments of the filter 1000*a* may be a bandpass filter that is deployed in the receive path or transmit path of a radio frequency communication system. The radio frequency communication system may include base stations or access points that transmit, receive, or broadcast RF signals to user equipment within a wireless communication system. For example, the filter 1000*a* may be used to filter signals that are broadcast by a broadcast station at relatively high power, e.g., at powers near or above 10 kW. Some embodiments of the filter 1000*a* may be tunable or adjustable to selectively filter signals in a frequency range between 400 MHz and 900 MHz or other frequency ranges. According to some embodiments, adjustability is required for two reasons: 1. to track a filter's bandwidth over a tuning range, 2. To suit a variety of different selectivity masks for different global transmission modes, like DVB-T, ISDB-T, ATSC, etc. In other applications different modes may require different bandwidths. Adjusting the bandwidth of the filter 1000*a* may include changing the center frequency or the filter bandwidth or a selectivity mask. According to some embodiments, filter center frequency tuning and filter bandwidth tuning are two separate things. A national transmission frequency range may be 470 MHz to 700 MHz and the filter bandwidth may be 6,7 or 8 MHz for example and the filter passband width needs to be constant over the filter tuning range.

The filter 1000*a* is formed of six cavity resonators 1101, 1102, 1103, 1104, 1105, 1106 (collectively referred to as "the cavity resonators 1101-1106"). However, some embodiments of the filter 1000*a* may include more or fewer cavity resonators. Some embodiments of the cavity resonators 1101-1106 may be implemented as TE-101 mode resonators or transverse electromagnetic wave mode (TEM) resonators. One or more of the cavity resonators 1101-1106, presently all cavity resonators 1101-1106, may include a corresponding inner conductor or loading element 1111, 1112, 1113, 1114, 1115, 1116 (collectively referred to as "the loading elements 1111-1116") that can be adjusted to change the loading, which may be a capacitive loading, in the cavity resonators 1101-1106, thereby changing the frequency response or transfer function of the cavity resonators 1101-1106. For example, loading elements 1111-1116 may be implemented using resonator rods and the depth of the resonator rod into the corresponding cavity resonator 1101-1106 may determine the capacitive loading. However, other types of loading elements 1111-1116 may be implemented in the cavity resonators 1101-1106.

Radio frequency signals may be introduced into the filter 1000*a* through an input port coupling 1200 in the cavity resonator 1101. The RF signals in the cavity resonator 1101 may then be transferred into the cavity resonator 1102 via a coupling structure 100*a*, into the cavity resonator 1103 via a coupling structure 100*b*, into the cavity resonator 1104 via a coupling structure 100*c*, into the cavity resonator 1105 via a coupling structure 100*d*, and into the cavity resonator 1106 via a coupling structure 100*e*. According to an embodiment, the coupling structures 100*a* to 100*e* may be referred to as direct coupling structures because they couple electromagnetic waves along a direct path from the input port 1200, through the cavity resonators 1101-1106, and out of an output port 1300. Some embodiments of the coupling structures 100*a*-100*e* may be implemented as electrical or capacitive coupling structures in order to suit a chosen coupling scheme for a given filter transfer function response. The filter 1000*a* may be referred to as a "U-shaped" folded filter because the cavity resonators 1101-1106 are deployed in an arrangement that resembles the letter U. However, some embodiments of the filter 1000*a* may implement other configurations of the cavity resonators 1101-1106 and more or fewer cavity resonators 1101-1106 may be deployed to form embodiments of the filter 1000*a*.

Some of the cavity resonators 1101-1106 may be cross-coupled. For example, the cavity resonators 1102, 1105 may be cross-coupled using a quasi-capacitive coupling structure 100*f*.

According to an embodiment, the quasi-capacitive coupling structure 100*f* may be configured similar or identical to the coupling element 100 explained above with reference to FIG. 1 to 10, e.g. may have a same or similar shape and/or same or similar properties.

According to a further embodiment, the quasi-capacitive coupling structure 100*f* may partially encompass a first area in a plane that is substantially perpendicular to a magnetic field in the cavity resonator 1102 and a second portion that may partially encompasses a second area in a plane that is substantially perpendicular to the magnetic field in the cavity resonator 1105. Inductive currents generated in the first portion (e.g., in a first end section 132 of a first coupling arm 130, also cf. FIG. 1) of the quasi-capacitive coupling structure 100*f* flow in substantially the same direction as current in the second portion (e.g., in a second end section 134 of the first coupling arm 130, also cf. FIG. 1).

According to an embodiment, the quasi-capacitive coupling structure 100*f* may invert the phase of RF signals that are conveyed between the cavity resonator 1102 and the cavity resonator 1105 (FIG. 11). Consequently, the quasi-capacitive coupling structure 100*f* maintains the correct phase relationships between signals in the coupled resonators 1102, 1105 and preserves the overall shape of the transfer function of the filter 1000*a*. Some embodiments of the quasi-capacitive coupling structure 100*f* can be rotated to adjust its coupling strength. Adjustments to the coupling constant may e.g. be performed in coordination with adjusting a frequency response of one or more of the cavity resonators 1101-1106 to produce a target transfer function of the filter 1000*a*.

Generally, more than one coupling element 100, 100*f* according to the embodiments may be employed in cavity resonator devices 1000, 1000*a* such as e.g. RF bandpass filters and the like.

Figure 12:
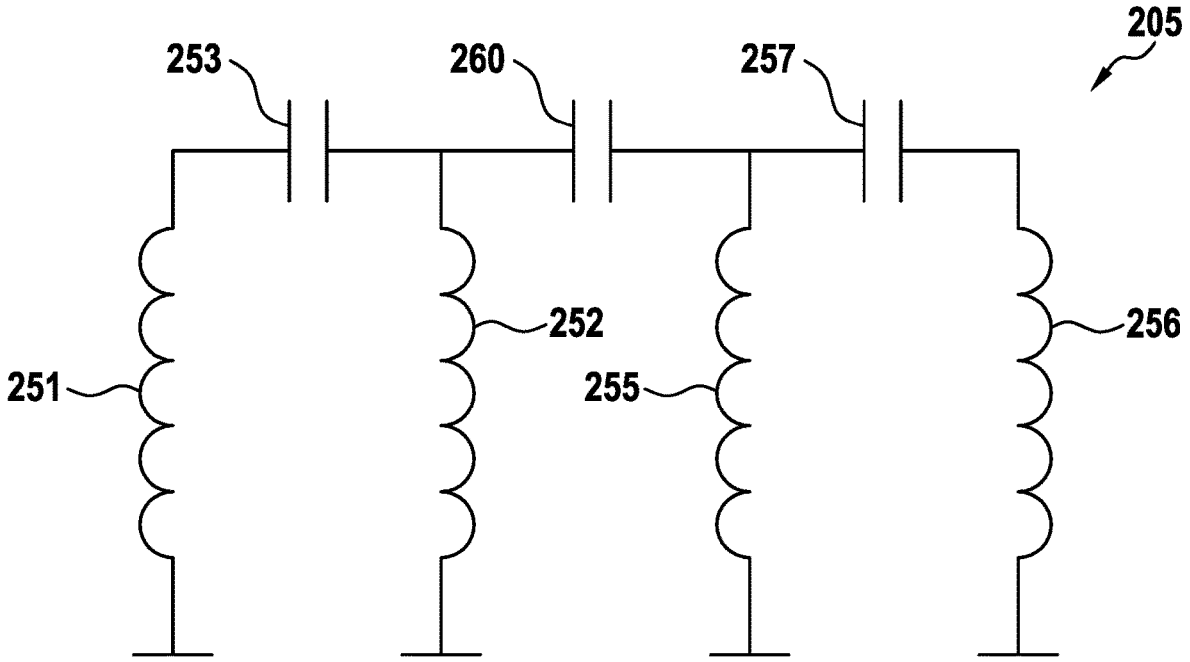

FIG. 12 depicts an effective electrical equivalent circuit 205 of the coupling element 100 together with two associated cavity resonators 1010, 1020, as e.g. depicted by FIG. 9, according to some embodiments. A coupled cavity resonator pair may e.g. include a first cavity resonator 1010 (FIG. 9) and a second cavity resonator 1020, wherein the cavities are formed of a respective cover plate 1010*b*, 1020*b*, a respective base plate 1010*c*, 1020*c*, and a common side wall 1030. Each of the cavity resonators 1010, 1020 may include a corresponding loading element 1010*a*, 1020*a*, as already mentioned above, that can be adjusted to change the capacitive loading in the cavity resonators 1010, 1020, thereby changing the resonator frequency of the cavity resonators 1010, 1020 and the coupled cavity resonator pair. Some embodiments of the coupled cavity resonator pair may be implemented as the cross-coupled cavity resonators 1102, 1105 in the filter 1000*a* shown in FIG. 11.

Returning to FIG. 9, the cavity resonators 1010, 1020 are coupled by the coupling element 100, acting e.g. as a quasi-capacitive coupling loop. Portions of the coupling element 100 define areas in the cavity resonators 1010, 1020. For example, section 134 of the first coupling arm 130 partially encompasses a first area A1 (also cf. FIG. 1) in the cavity resonator 1010 that is also bounded by the longitudinal axis a1 (as well as by portions of the top section 120 and the intermediate section 136), and section 132 of the first coupling arm 130 partially encompasses a second area A2 (also cf. FIG. 1) in the cavity resonator 1020 (FIG. 9) that is also bounded by the longitudinal axis a1. The second coupling arm 140 defines similar coupling areas A3, A4 (FIG. 1). Magnetic fields near the common wall 1030 (FIG. 9) of the cavity resonators 1010, 1020 may pass through or "penetrate" into the projected loop areas and thereby induce a coupling current in the loops, and the areas A1, A2, A3, A4 (cf. FIG. 1) bounded by the coupling arms 130, 140 of the coupling element 100 are in the plane of FIG. 9. Thus, the areas A1, A2, A3, A4 bounded by the coupling element 100 may lie in a plane that is substantially perpendicular to magnetic fields in the cavity resonators 1010, 1020. However, the magnetic field may not be perfectly perpendicular to the plane of FIG. 9 and may include components that are in the plane of FIG. 9. The term "substantially perpendicular" is intended to encompass these variations in the direction of the magnetic field near the common wall 1030 of the cavity resonators 1010, 1020.

Magnetic fields produced by electromagnetic waves in the cavity resonators 1010, 1020 may produce an inductive current in the coupling arms 130, 140 of the coupling element 100. For example, introducing RF signals into the cavity resonator 1010 produces time varying magnetic fields in the sections 134, 142 of the coupling element 100 that lie within the cavity resonator 1010. The inductive current may flow through the sections 134, 142 of the coupling element 100 in a substantially same direction, which causes corresponding currents in the further sections 132, 144 of the coupling element 100 thus effecting a magnetic coupling from the first cavity resonator 1010 via said coupling element 100 to said second cavity resonator 1020.

According to an embodiment, a current direction through the coupling arms 130, 140 determines a phase angle of the coupling between electromagnetic waves in the cavity resonators 1010, 1020. Since the direction of the current in the sections 134, 132 and 144, 142 is substantially the same, the phase of electromagnetic waves is inverted by traversing the coupling element's arms 130, 140 between the cavity resonators 1010, 1020 relative to the phase produced by traditional U-shaped coupling loops. According to an embodiment, coupling may exist only between vertical sections 132, 134, 142, 144 of the coupling element 100 and the adjacent cavity resonators 1010, 1020 because of an axisymmetric magnetic field direction about the loading elements 1010*a*, 1020*a* within the cavity resonators 1010, 1020. Consequently, advantageously a quasi-capacitive coupling is achieved at a location where conventionally only inductive coupling is possible.

The coupled cavity resonator pair 1010, 1020 of FIG. 9 may be represented by the effective electrical equivalent circuit 205 depicted by FIG. 12. For example, the cavity resonator 1010 may be represented by inductances 251, 252 and capacitor 253. The cavity resonator 1020 may be represented by inductances 255, 256 and capacitor 257. The quasi-capacitive coupling between the cavity resonators 1010, 1020 formed by the coupling element 100 may then be represented by the capacitor 260. The strength of the quasi-capacitive coupling may inter alia be determined by the areas A1, A2, A3, A4 bounded by the coupling arms 130, 140 in the cavity resonators 1010, 1020 and hence e.g. be influenced by rotating said coupling element 100 around its longitudinal axis a1 (FIG. 9), whereby the effective coupling areas are altered. Also, due to the presence of at least two coupling arms 130, 140, the coupling element 100 according to the embodiments offers a particularly strong coupling as compared to conventional systems. According to some embodiments, the coupling may further be enhanced by adding a third or even further coupling arms.

The coupling element and the cavity resonator device according to the embodiments advantageously enable to provide high-performance high-power RF filters 1000*a* with optimized peak-power and average-power handling, as well as external adjustability and moderate costs as compared with conventional systems. Also, undesired self-resonances inside an operational filter tuning range may be avoided when employing the inventive approach.

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

It should be appreciated by those skilled in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

The invention claimed is:

1. A cavity resonator device comprising at least two adjacent cavity resonators for radio frequency (RF) signals, separated by a common side wall having an opening, wherein said cavity resonator device comprises at least one coupling element for coupling two adjacent cavity resonators of the at least two cavity resonators of said cavity resonator device, wherein said at least one coupling element comprises a base section and a top section, wherein said top section is displaced vertically from said base section by a first distance along a longitudinal axis of said at least one coupling element, and wherein said at least one coupling element comprises at least a first coupling arm and a second coupling arm, each of said coupling arms connecting said base section with said top section, wherein said at least one coupling element is arranged rotatably around an axis of rotation with respect to said wall in said opening, wherein wall sections adjacent to said opening comprise a slanted front section, wherein said axis of rotation is said longitudinal axis of said at least one coupling element or an axis parallel thereto, and wherein said axis of rotation projects through the base section and the top section of the at least one coupling element.

2. A cavity resonator device comprising at least two adjacent cavity resonators for radio frequency (RF) signals, separated by a common side wall having an opening, wherein said cavity resonator device comprises at least one coupling element for coupling two adjacent cavity resonators of the at least two cavity resonators of said cavity resonator device, wherein said at least one coupling element comprises a base section and a top section, wherein said top section is displaced vertically from said base section by a first distance along a longitudinal axis of said at least one coupling element, and wherein said at least one coupling element comprises at least a first coupling arm and a second coupling arm, each of said coupling arms connecting said base section with said top section, wherein said at least one coupling element is arranged rotatably around an axis of rotation with respect to said wall in said opening, wherein said axis of rotation is said longitudinal axis of said at least one coupling element or an axis parallel thereto, and wherein said axis of rotation projects through the base section and the top section of the at least one coupling element, wherein said first coupling arm comprises a first end section connected to said base section, a second end section connected to said top section, and an intermediate section connecting said first end section with said second end section, and/or wherein said second coupling arm comprises a first end section connected to said base section, a second end section connected to said top section, and an intermediate section connecting said first end section with said second end section.

3. The cavity resonator device according to claim 2, wherein the first end sections of the first and second coupling arms are arranged in opposing axial end sections of said base section, and/or wherein the second end sections of the first and second coupling arms are arranged in opposing axial end sections of said top section.

4. The cavity resonator device according to claim 2, wherein at least one of said end sections and/or at least one of said intermediate sections comprises a cylindrical shape.

5. The cavity resonator device according to claim 2, wherein a longitudinal axis of at least one of said end sections is parallel to said longitudinal axis of said coupling element.

6. The cavity resonator device according to claim 2, wherein a first angle between said first end section and said intermediate section of said first coupling arm and/or a second angle between said second end section and said intermediate section of said first coupling arm and/or a third angle between said first end section and said intermediate section of said second coupling arm and/or a fourth angle between said second end section and said intermediate section of said second coupling arm ranges between 50 degrees and 130 degrees.

7. The cavity resonator device according to claim 2, wherein at least one of said coupling arms is arranged in a respective virtual plane, wherein an angle between said respective virtual plane and said longitudinal axis of said coupling element ranges between −20 degrees and 20 degrees.

8. A cavity resonator device comprising at least two adjacent cavity resonators for radio frequency (RF) signals, separated by a common side wall having an opening, wherein said cavity resonator device comprises at least one coupling element for coupling two adjacent cavity resonators of the at least two cavity resonators of said cavity resonator device, wherein said at least one coupling element comprises a base section and a top section, wherein said top section is displaced vertically from said base section by a first distance along a longitudinal axis of said at least one coupling element, and wherein said at least one coupling element comprises at least a first coupling arm and a second coupling arm, each of said coupling arms connecting said base section with said top section, wherein said base section and/or said top section comprises a planar shape, wherein said at least one coupling element is arranged rotatably around an axis of rotation with respect to said wall in said opening, wherein said axis of rotation is said longitudinal axis of said at least one coupling element or an axis parallel thereto, and wherein said axis of rotation projects through the base section and the top section of the at least one coupling element.

9. The cavity resonator device according to claim 1, wherein a surface of at least one of said coupling arms is curved and comprises a minimum curve radius of 1 millimeter to 5 millimeters.

10. The cavity resonator device according to claim 1, wherein at least one component of the at least one coupling element is made of an electrically conductive material and/or comprises an electrically conductive surface.

11. The cavity resonator device according to claim 1, wherein at least one of said coupling arms at least partially comprises an elliptically cylindrical section.

12. The cavity resonator device according to claim 1, wherein at least one further coupling arm is provided which connects said base section with said top section.

13. An apparatus comprising: the cavity resonator device according to claim 1, wherein the apparatus is at least one of: a base station and an access point.

14. The cavity resonator device according to claim 1, wherein a tuning mechanism is provided which is coupled with said at least one coupling element for driving a rotational movement of said at least one coupling element with respect to said wall.

15. The cavity resonator device according to claim 1, wherein said at least one coupling element is arranged in said opening such that a first portion of said first coupling arm is positioned within a first one of said adjacent cavity resonators, and that a second portion of said first coupling arm is positioned within a second one of said adjacent cavity resonators, and wherein said at least one coupling element is arranged in said opening such that a first portion of said second coupling arm is positioned within said second one of said adjacent cavity resonators, and that a second portion of said second coupling arm is positioned within said first one of said adjacent cavity resonators.

* * * * *